US010267076B2

(12) United States Patent
Varsanyi et al.

(10) Patent No.: US 10,267,076 B2
(45) Date of Patent: Apr. 23, 2019

(54) CONNECTING DEVICE AND WINDOW OR DOOR COMPRISING A CONNECTING DEVICE

(71) Applicant: ROTO FRANK AG, Leinfelden-Echterdingen (DE)

(72) Inventors: Zsolt Varsanyi, Sopron (HU); Thorsten Issler, Dettenhausen (DE); Markus Peter, Nuertingen (DE); Tamas Nyikos, Sopron (HU); Stefan Fingerle, Rommelsbach (DE); Gyoergy Kiss, Gencsapati (HU)

(73) Assignee: ROTO FRANK AG, Leinfelden-Echterdingen (DE)

( * ) Notice: Subject to any disclaimer, the term of this patent is extended or adjusted under 35 U.S.C. 154(b) by 0 days.

(21) Appl. No.: 15/744,189

(22) PCT Filed: Jul. 7, 2016

(86) PCT No.: PCT/EP2016/066103
§ 371 (c)(1),
(2) Date: Jan. 12, 2018

(87) PCT Pub. No.: WO2017/009164
PCT Pub. Date: Jan. 19, 2017

(65) Prior Publication Data

US 2018/0202211 A1 Jul. 19, 2018

(30) Foreign Application Priority Data

Jul. 13, 2015 (DE) ..... 10 2015 213 058

(51) Int. Cl.
*E06B 1/04* (2006.01)
*E05D 15/30* (2006.01)
(Continued)

(52) U.S. Cl.
CPC ..... *E05D 15/30* (2013.01); *E05D 5/023* (2013.01); *E05D 5/0215* (2013.01); *E05D 15/28* (2013.01);
(Continued)

(58) Field of Classification Search
CPC ... E05D 15/30; E05D 5/023; E05Y 2600/628; E05Y 2900/132; E05Y 2201/48; E05Y 2900/148; E05Y 2600/53; E05Y 2600/528
(Continued)

(56) References Cited

U.S. PATENT DOCUMENTS 9,470,023 B2 * 10/2016 Bai ..... E05B 65/0888
2003/0213100 A1 11/2003 Brain et al.
(Continued)

FOREIGN PATENT DOCUMENTS

CN 1550627 A 12/2004
CN 1657736 A 8/2005
(Continued)

OTHER PUBLICATIONS

International Search Report of PCT/EP2016/066103, dated Sep. 15, 2016.
(Continued)

*Primary Examiner* — Basil S Katcheves
(74) *Attorney, Agent, or Firm* — Collard & Roe, P.C.

(57) ABSTRACT

A connecting device, in particular for installing at least one opening stay on a window leaf has a rail, which can be guided as far as possible in the direction of the first longitudinal axis thereof into a groove of the connecting device. The groove engages at least in sections behind the rail. The blocking of the longitudinal displaceability of the rail in the groove is guaranteed at least counter to the first longitudinal direction by a projection connected to the rail, which projection engages in a recess in the region of the groove. The
(Continued)

projection is held in the installed position of the connecting device by a spring element in the recess. A spring element is arranged on the rail preferably in a limited movable manner. Alternatively or in addition, the connecting device can comprise a cap which holds the projection in the installed position of the connecting device indirectly and/or directly at least partially in the recess.

10 Claims, 3 Drawing Sheets

(51) Int. Cl.
*E05D 5/02* (2006.01)
*E05D 15/28* (2006.01)
*E05D 15/52* (2006.01)
*E06B 1/52* (2006.01)

(52) U.S. Cl.
CPC ..... *E05D 15/5205* (2013.01); *E05Y 2201/48* (2013.01); *E05Y 2600/50* (2013.01); *E05Y 2600/528* (2013.01); *E05Y 2600/53* (2013.01); *E05Y 2600/626* (2013.01); *E05Y 2600/628* (2013.01); *E05Y 2900/132* (2013.01); *E05Y 2900/148* (2013.01); *E06B 1/526* (2013.01)

(58) Field of Classification Search
USPC ..... 52/204.1
See application file for complete search history.

(56) References Cited

U.S. PATENT DOCUMENTS

2007/0289100 A1* 12/2007 Lake ..... E05D 15/30 16/362
2010/0071269 A1* 3/2010 Isley ..... E05D 11/1007 49/404

FOREIGN PATENT DOCUMENTS

| | | | |
|---|---|---|---|
| DE | 2404267 | A1 | 7/1975 |
| DE | 2451556 | A1 | 5/1976 |
| DE | 2461268 | A1 | 7/1976 |
| DE | 30 41 221 | | 5/1982 |
| DE | 33 20 824 | | 12/1984 |
| DE | 3446215 | A1 | 9/1986 |
| DE | 40 39 961 | | 6/1992 |
| DE | 20 2004 003 157 | | 5/2004 |
| DE | 10 2012 104 853 | | 12/2013 |
| GB | 2 457 340 | | 8/2009 |

OTHER PUBLICATIONS

Chinese Search Report dated Dec. 11, 2018 in Chinese Application No. 201680041112.9 with English translation.

* cited by examiner

CONNECTING DEVICE AND WINDOW OR DOOR COMPRISING A CONNECTING DEVICE

CROSS REFERENCE TO RELATED APPLICATIONS

This application is the National Stage of PCT/EP2016/066103 filed on Jul. 7, 2016, which claims priority under 35 U.S.C. § 119 of German Application No. 10 2015 213 058.4 filed on Jul. 13, 2015, the disclosures of which are incorporated by reference. The international application under PCT article 21(2) was not published in English.

BACKGROUND OF THE INVENTION

The invention relates to a connecting device of a window or a door. The invention also relates to a window or a door comprising a connecting device of this type.

It is known to arrange elements, in particular stays, on windows or doors by means of a rail. The rail is generally fastened by means of a screw connection. However, when assembling a window or a door, establishing a screw connection of this kind is complex and time-consuming.

DE 30 41 221 A1 discloses providing a sash with a rail fitting which supports and guides stay arms. DE 30 41 221 A1 also discloses providing an actuatable blocking member. The blocking member is actuated by means of a main drive rod. Depending on the position of the main drive rod, the blocking member blocks an additional drive rod or allows said additional drive rod to move.

DE 10 2012 104 853 A1 discloses a guide rail arrangement comprising a guide rail and a slide that is movably guided in the guide rail. The guide rail comprises mounting openings by means of which the guide rail can be fastened to a door leaf. The slide can move relative to a block which is rigidly screwed into the guide rail. The slide and the block are interlocked.

DE 20 2004 003 157 U1 discloses a cupboard unit comprising a guide rail. The guide rail is mounted on a base of the cupboard unit by means of a retaining element. The retaining element and the guide rail are interlockingly connected, for example by means of a pin of the guide rail, which pin engages in a hole in the retaining element. The known guide rail can be in the form of an extruded profile. Furthermore, the known guide rail can be formed in several parts, it being possible for the individual parts of the guide rail to be interconnected by means of a lockable butt connector.

DE 33 20 824 A1 discloses a stay apparatus for a window or a door, comprising a stay. The stay comprises a stay arm and a control arm. One end of the stay arm is rotatably arranged on a frame of the window or the door and the other end of which stay arm is rotatably arranged on a slide which is arranged in a guide rail such that it can slide. The guide rail is fixed in a groove fitting of a sash of the window or the door.

SUMMARY OF THE INVENTION

By contrast, the object of the present invention is to provide a means for fastening rails in a groove, which means can be assembled securely and without using any tools.

The object of the invention is therefore achieved by a connecting device of a window or a door, the connecting device comprising the following:

a. a rail;

b. a groove having an at least partially C-shaped cross section, it being possible to introduce the rail into the groove in a first longitudinal direction of said groove, portions of the C shape engaging the rail from behind;

c. a recess in the groove;

d. a projection, it being possible for the projection to be received in the recess at least in part so as to block the movement of the rail that is inserted in the groove relative to the groove and counter to the first longitudinal direction;

e. a spring element for loading the projection into the recess by a spring force;

f. a stop for blocking the movement of the rail that is inserted in the groove in the first longitudinal direction;

such that the rail (18) is held in the groove (20) without play when said rail (18) is mounted therein.

The rail can be introduced into the groove almost completely. When the rail is introduced, i.e. in the mounted state, the rail is held perpendicularly to the bottom of the groove by being engaged from behind by the at least partially C-shaped cross section. In other words, the rail is held in the C shape such that the rail can only move in the first longitudinal direction and counter to the first longitudinal direction.

In the first longitudinal direction of the groove, i.e. in the introduction direction of the rail, the rail is held by means of the stop. In the opposite direction, i.e. counter to the first longitudinal direction of the groove, the rail is held by means of the projection, which abuts the recess at least in part.

In this respect, when the rail is introduced into the recess, the spring element makes the projection snap into place. Therefore, the rail can be introduced into the groove and automatically completely secured, in all directions, in said groove such that it is locked therein. In this case, the rail being fastened in the groove without play is understood to mean that the fit therebetween has an amount of play which is sufficient for it to be possible to mount the rail in the groove without using any tools, but also for it to be held therein without movement play. Therefore, the design according to the invention of the connecting device makes it possible to mount the rail in the groove in a simple manner and without using any tools.

The projection is preferably arranged or formed on the spring element.

The connecting device is structurally simple and particularly flat when the spring element is in the form of a leaf spring. The leaf spring is preferably connected to the rail by means of at least one rivet. The connecting device has a particularly low amount of wear when the spring element is connected to the rail by means of at least two rivets.

It is also preferable for the stop to be formed at least in part by the recess. More precisely, the first projection abuts the recess when the rail is inserted in the groove, so as to form the stop at least in part. The stop may be formed entirely by the recess.

The inner contour of the recess preferably corresponds to the associated outer contour of the projection, and therefore the projection is held in the recess such that there is substantially no play or such that it is substantially unable to move.

The structural design is simplified and it is made easier to produce the connecting device if the recess and the projection each have a circular cross section.

In order to prevent the projection from being pushed beyond the recess when the rail is inserted in the groove, at least part of the stop can be arranged or formed on the spring element, the stop which is arranged or formed at least in part on the spring element limiting the insertion of the rail in the groove in the first longitudinal direction, in particular by abutting an end face of the groove when the rail is inserted in said groove. The stop may be arranged or formed entirely on the spring element.

The spring element can comprise a first arm which comprises the stop at least in part. The first arm is preferably arranged on the spring element, but said first arm is more preferably formed on the spring element.

The spring element can comprise an additional stop which engages the rail from behind and limits the range of motion of the spring element relative to the rail. In this case, the additional stop preferably limits the range of motion of the spring element perpendicularly to the bottom of the groove. The first arm preferably comprises the additional stop at least in part.

Furthermore, the spring element can comprise a second arm. Together with the first arm, the second arm can form the stop.

Furthermore, together with the first arm, the second arm can form the additional stop and engage the rail from behind so as to limit the range of motion of the spring element relative to the rail. In this case, the second arm preferably limits the range of motion of the spring element perpendicularly to the bottom of the groove.

It is made easier to produce the connecting device if the second arm is mirror symmetrical to the first arm. The second arm is preferably arranged on the spring element, but said second arm is more preferably formed on the spring element.

In a more preferred embodiment of the invention, the connecting device comprises a fork, the projection comprising a notch and the fork surrounding the notch at least in portions when the connecting device is assembled, in order to prevent the projection from being accidentally removed from the recess.

The fork can be arranged or formed in a cap which can be pushed onto the rail in portions. The cap makes it possible, in a convenient manner, for the fork to be pushed onto the notch. Furthermore, the cap is preferably designed such that it can be pushed onto the rail as far as its end position only if the fork engages in the notch at least in portions. In this case, an installer knows that the rail is correctly arranged in the groove if the cap can be pushed thereon.

In a particularly preferred embodiment of the invention, the connecting device comprises a stay which is arranged on the rail. In other words, the connecting device according to the invention is especially suitable for installing a stay. More preferably, the connecting device comprises a plurality of stays which are each arranged on the rail. In this case, the invention makes it possible for a plurality of stays to be installed without using any tools by simply inserting the rail in the groove.

The object of the invention is also solved by a window or a door comprising a connecting device of the kind described above.

The window or the door can comprise a frame and a sash. The groove can be arranged on a sash frame. Alternatively, the groove can be formed on a sash frame. The groove is preferably located on an upper longitudinal side of the sash frame. The groove is preferably formed in a profile, in particular an extruded profile. The profile is more preferably arranged on the sash frame, in particular screwed onto the sash frame.

Further features and advantages of the invention will become apparent from the following detailed description of an embodiment of the invention, the claims and on the basis of the figures of the drawings, which show details that are essential to the invention.

The features shown in the drawings are depicted such that the particularities of the invention can be made clearly visible. The various features may be implemented individually or in any combination in variants of the invention.

BRIEF DESCRIPTION OF THE DRAWING FIGURES

Figure 2:
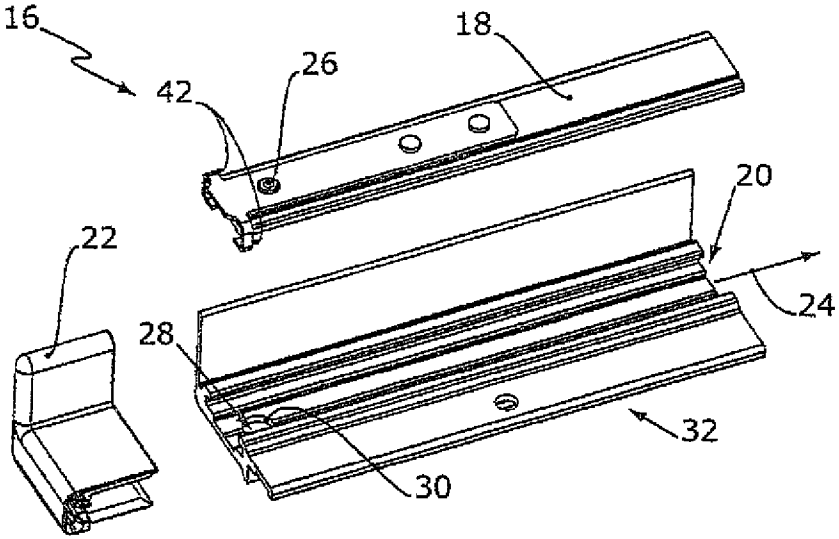
FIG. 2 is a perspective exploded view of part of the connecting device from FIG. 1.
Figure 3B:
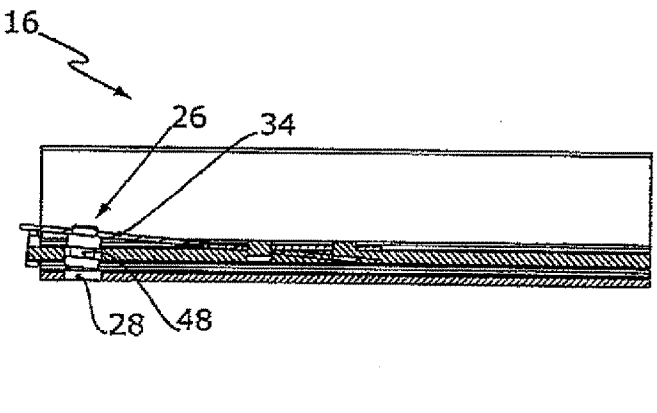
Figure 3A:
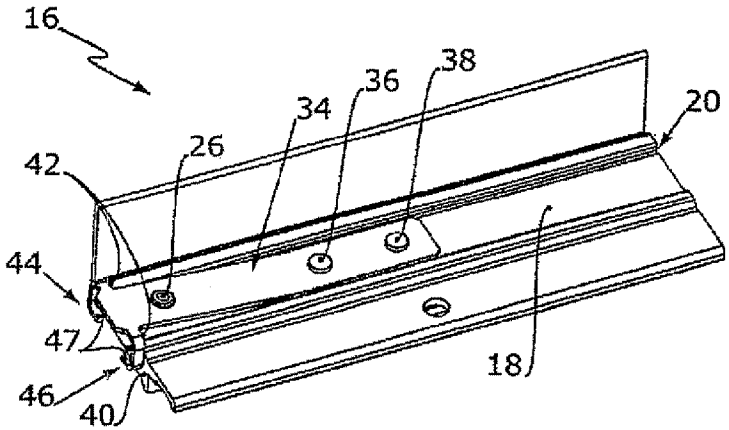

FIG. 3*a* is a perspective view of the connecting device according to FIG. 2 when only partially assembled;

FIG. 3*b* is a sectional view of the connecting device according to FIG. 3*a;*

Figure 4B:
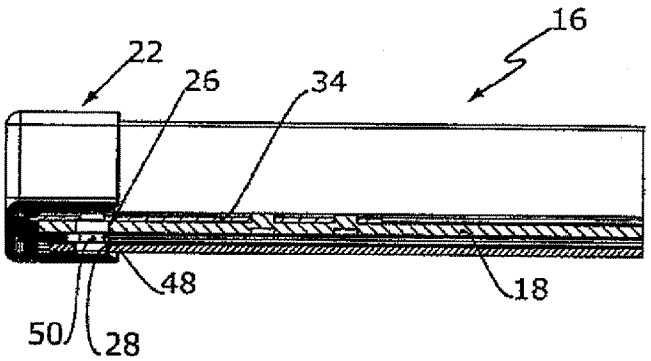
Figure 4A:
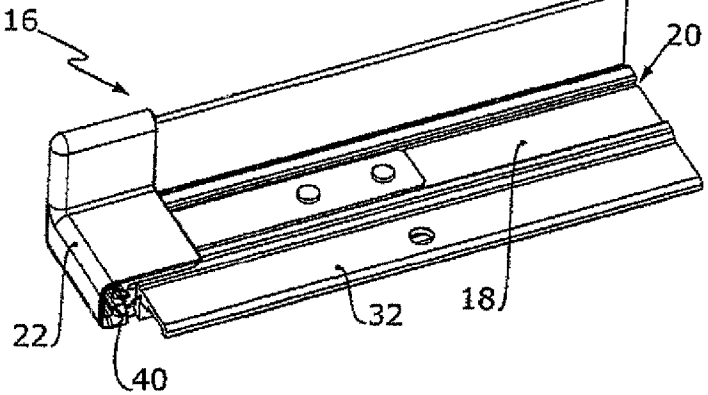
Figure 4C:
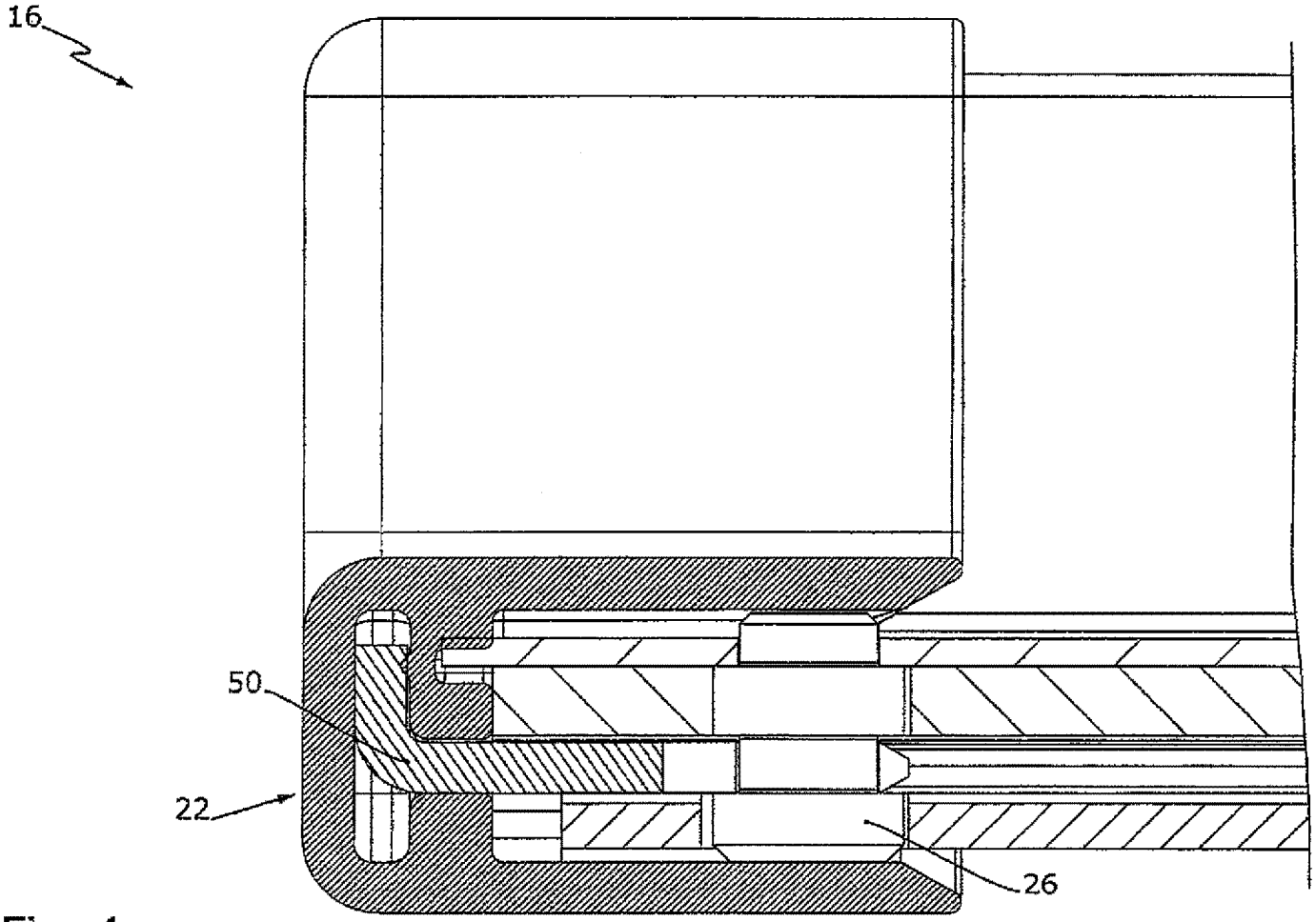

FIG. 4*a* is a perspective view of the connecting device according to FIGS. 1 to 3*b* when completely assembled;

FIG. 4*b* is a sectional view of the connecting device according to FIG. 4*a*; and FIG. 4*c* is an enlarged view of part of the sectional view of the connecting device according to FIG. 4*b*.

DETAILED DESCRIPTION OF THE INVENTION

Figure 1:
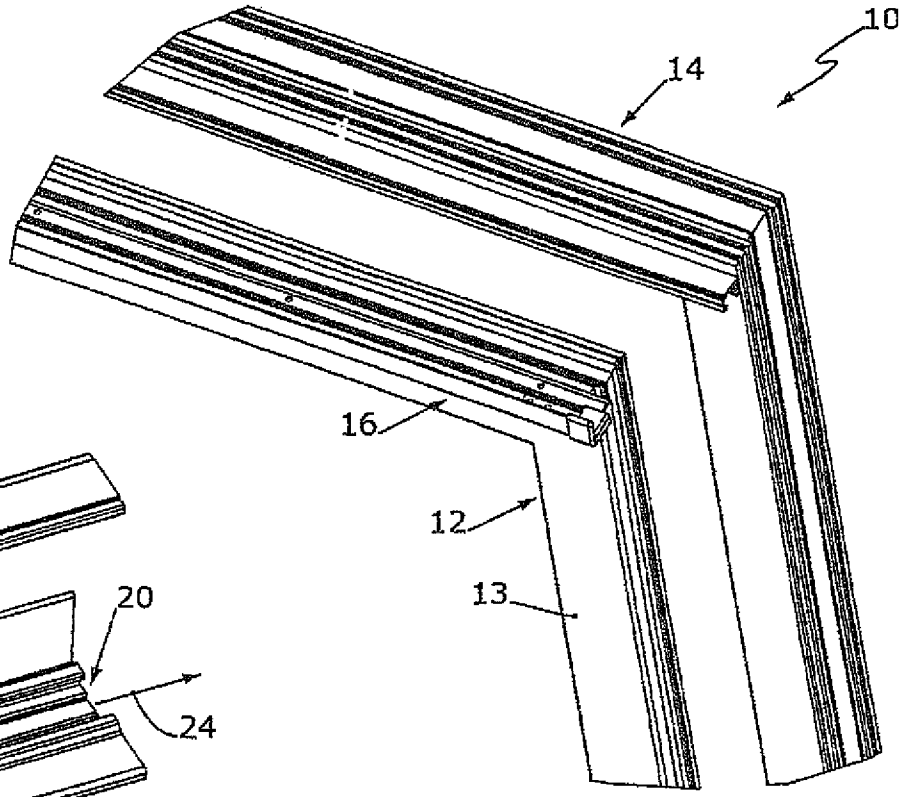
FIG. 1 is a perspective view of part of a window comprising a connecting device.

FIG. 1 shows a window 10 comprising a sash 12 which comprises a sash frame 13, and a window frame 14. The sash 12 is connected to the window frame 14 by means of at least one stay (not shown), in particular two stays. In this case, the stays are arranged on the sash 12 by means of a connecting device 16.

FIG. 2 shows part of the connecting device 16. The connecting device 16 comprises a rail 18, a groove 20 and a cap 22. The inner contour of the groove 20 has a C-shaped cross section. The rail 18 can be introduced into the groove 20 in a first longitudinal direction 24. If the rail 18 is inserted in the groove 20 as far as a second stop 42 (see also FIG. 3*a*), a projection 26 (see also FIG. 3*b*), which points downwards in FIG. 2 and which is not immediately visible in FIG. 2, locks in a recess 28 in the groove 20. The projection 26 being locked in the recess 28 prevents the rail 18 from being pulled out counter to the first longitudinal direction 24. Furthermore, a first stop 30 is formed by the recess 28, which stop prevents the rail 18 from being inserted further in the first longitudinal direction 24. The first stop 30 and the second stop 42 together form a stop which prevents the rail 18 from being inserted further in the first longitudinal direction 24 when the connecting device 16 is assembled.

In the context of the present invention, the rail 18 is referred to as being inserted in the groove 20 when the rail 18 is inserted for the most part into the groove 20 such that it reaches its end position. In this state, the projection 26 can protrude into the recess 28 at least in part.

The groove 20 is part of a profile 32, in particular in the form of an extruded profile. The profile 32 is screwed onto the sash frame 13 (see FIG. 1). The rail 18 that is inserted in the groove 20 is therefore securely and rigidly connected to the sash 12 (see FIG. 1).

FIG. 3*a* shows the connecting device 16 when partially assembled. It can be seen from FIG. 3*a* that the connecting device 16 comprises a spring element 34. The spring element 34 is in the form of a leaf spring. The spring element 34 is connected to the rail 18 by means of rivets 36, 38.

According to FIG. 3*a*, one end of the rail 34 is bent away from the rail 18. When the spring element 34 is unactuated, the longitudinal axis of the spring element 34 extends in parallel with the longitudinal axis of the rail 18.

In order to assemble the connecting device 16, the spring element 34 is bent, in part, away from the rail 18 in order to prevent the projection 26 (see also FIG. 3*b*) from pressing against an end face 40 of the groove 20.

The second stop 42 indicates to an installer that the rail 18 is inserted in the groove 20 such that it is in its end position. The second stop 42 is formed on a first arm 44 and a second arm 46.

Furthermore, the arms 44, 46 engage part of the rail 18 from behind in order to prevent the spring element 34 from bending too far perpendicularly to the bottom of the groove 20. More precisely, a third stop 47 prevents the spring element 34 from bending too far, which stop is formed by the arms 44, 46. At least the first arm 44, in particular the two arms 44, 46, is/are, as shown in FIG. 3*a*, formed integrally with the spring element 34, and therefore the connecting device 16 can be produced in a particularly simple manner and has a structurally simple design.

FIG. 3*b* is a longitudinal section through the connecting device 16 according to FIG. 3*a*. The projection 26 arranged on the spring element 34 can be seen particularly clearly in FIG. 3*b*.

The projection 26 is in the form of a pin. The projection 26 is fastened to the spring element 34 by means of rivets. The projection 26 comprises a notch 48 by means of which the projection 26 can be held in the recess 28, as explained in the following.

FIG. 4*a* shows the connecting device 16 when completely assembled. In this state, when the rail 18 is arranged in the groove 20, the cap 22 can be pushed onto the profile 32 to such an extent that the inside of the cap 22 presses against the end face 40 of the groove 20 or the profile 32. The cap 22 can be mounted such that it reaches its end position only if the projection 26 (see FIG. 4*b*) is in its end position in the recess 28 (see FIGS. 3*b* and 4*b*).

FIG. 4*b* is a longitudinal section through the connecting device 16 in the end position in which it is completely assembled. It can be seen from FIG. 4*b* that the cap 22 comprises a fork 50 which surrounds the notch 48 (see also FIG. 3*b*) of the projection 26 at least in portions. In the present case, the cap 22 presses the spring element 34 against the rail 18 and the fork 50 of the cap 22 holds the projection 26 in the recess 28 such that it cannot move. The connecting device 16 according to the invention is thus particularly compact, can be opened in a reliable manner, and yet can be assembled without using any tools.

FIG. 4*c* is an enlarged partial view of the connecting device 16 according to FIG. 4*b* which shows how the projection 26 is secured by means of the fork 50. The fork 50 is injection moulded at least in part in the cap 22 or is locked at least in part in the cap 22 with an interlocking fit, and therefore the fork 50 is captively arranged in the cap 22.

If all of the figures of the drawings are considered in combination, the invention relates to a connecting device 16, in particular for mounting at least one stay on a window sash 12. The connecting device 16 comprises a rail 18 which can be introduced as far as possible into a groove 20 in the connecting device 16 in the direction of the first longitudinal axis 24 of said rail. The groove 20 engages the rail 18 from behind at least in portions. A projection 26 that is connected to the rail 18 and engages in a recess 28 in the region of the groove 20 ensures that the longitudinal movement of the rail 18 in the groove 20 is blocked at least counter to the first longitudinal direction 24. The projection 26 is held in the recess 28 by a spring element 34 when the connecting device 16 is in the assembled position. The spring element 34 is preferably arranged on the rail 20 such that it can move in a limited manner. Alternatively or additionally, the connecting device 16 can comprise a cap 22 which indirectly and/or directly holds the projection 26 in the recess 28 at least in part when the connecting device 16 is in the assembled position.

What is claimed is:

1. A connecting device (16) of a window (10) or a door, wherein the connecting device (16) comprises the following:

a. a rail (18);

b. a groove (20) having an at least partially C-shaped cross section, wherein the rail (18) can be introduced into the groove (20) in a first longitudinal direction (24) of the groove (20), wherein portions of the C shape engage the rail (18) from behind;

c. a recess (28) in the groove (20);

d. a projection (26), wherein the projection (26) can be received in the recess (28) at least in part so as to block the movement of the rail (18) that is inserted in the groove (20) relative to the groove (20) and counter to the first longitudinal direction (24);

e. a spring element (34) for loading the projection (26) into the recess (28) by a spring force;

f. a stop (30, 42) for blocking the movement of the rail (18) that is inserted in the groove (20) in the first longitudinal direction (24);

such that the rail (18) is held in the groove (20) substantially without play when said rail (18) is mounted therein, wherein the stop (30, 42) is arranged or formed at least in part on the spring element (34), and wherein the spring element (34) comprises an additional stop (47) which engages the rail (18) from behind and limits the range of motion of the spring element (34) relative to the rail (18).

2. The connecting device according to claim 1, wherein the spring element (34) is in the form of a leaf spring.

3. The connecting device according to claim 1, wherein the stop (30, 42) is formed at least in part by the recess (28) which the projection (26) abuts when the rail (18) is inserted in the groove (20).

4. The connecting device according to claim 1, wherein the recess (28) and the projection (26) have a circular cross section.

5. The connecting device according to claim 1, wherein the stop (30, 42) and the additional stop (47) are formed at least in part in a first arm (44) which engages the rail (18) from behind and limits the range of motion of the spring element (34) relative to the rail (18).

6. The connecting device according to claim 5, wherein the connecting device (16) has a second arm (46) which is in particular mirror symmetrical to the first arm (44), wherein, together with the second arm (46), the first arm (44) forms the stop (30, 42) and the additional stop (47) at least in part.

7. The connecting device according to claim 1, wherein the connecting device (16) comprises a fork (50) and the projection (26) comprises a notch (48), wherein the fork (50) surrounds the notch (48) at least in portions when the connecting device (16) is assembled, in order to prevent the projection (26) from being removed from the recess (28).

8. The connecting device according to claim 7, wherein the connecting device (16) comprises a cap (22) which can be pushed onto the rail (18) in portions, wherein the cap (22) comprises the fork (50).

9. The connecting device according to claim 1, wherein the connecting device (16) comprises a stay which is arranged on the rail (18).

10. A window (10) or door comprising the connecting device (16) according to claim 1.

* * * * *